US010168661B2

(12) United States Patent
Yamaguchi

(10) Patent No.: US 10,168,661 B2
(45) **Date of Patent: *Jan. 1, 2019**

(54) IMAGE FORMING APPARATUS

(71) Applicant: Sharp Kabushiki Kaisha, Osaka (JP)

(72) Inventor: Jun Yamaguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,929

(22) Filed: Dec. 3, 2017

(65) Prior Publication Data

US 2018/0088522 A1 Mar. 29, 2018

Related U.S. Application Data

(63) Continuation of application No. 15/262,720, filed on Sep. 12, 2016, now Pat. No. 9,864,326.

(30) Foreign Application Priority Data

Sep. 16, 2015 (JP) ..... 2015-182434

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1839; G03G 21/1842; G03G 21/185; G03G 21/1825
See application file for complete search history.

(56) References Cited

U.S. PATENT DOCUMENTS

| | | | |
|---|---|---|---|
| 2008/0138107 | A1 | 6/2008 | Mori |
| 2008/0267666 | A1 | 10/2008 | Shirokoshi |
| 2009/0297213 | A1 | 12/2009 | Satomura |
| 2009/0297214 | A1 | 12/2009 | Chadani |
| 2009/0297215 | A1 | 12/2009 | Munetsugu |
| 2010/0209138 | A1 | 8/2010 | Tani |
| 2012/0177400 | A1 | 7/2012 | Jang |
| 2013/0315621 | A1 | 11/2013 | Toriyama |

(Continued)

FOREIGN PATENT DOCUMENTS

JP 2015-082056 A 4/2015

OTHER PUBLICATIONS

Allowed Claims from U.S. Appl. No. 15/262,720, filed Sep. 12, 2016.

*Primary Examiner* — Ruifeng Pu
(74) *Attorney, Agent, or Firm* — Renner Otto Boisselle & Sklar, LLP

(57) ABSTRACT

An image forming apparatus comprises a developing unit and a developing unit attaching portion that is provided in an apparatus main body. The developing unit and the developing unit attaching portion are provided with an insertion guide. The insertion guide makes the developing unit a state it is inclined from a normal posture so as to be moved on a position departed from a photoreceptor drum during a period from a start of insertion of the developing unit into the developing unit attaching portion until just before completion of the insertion, and makes, during a period from just before completion of the insertion until completion of the insertion, the developing unit turn according to an insertion operation of the developing unit so as to be brought close to the photoreceptor drum, whereby the developing unit is positioned so as to take the normal posture.

7 Claims, 10 Drawing Sheets

(56) References Cited

U.S. PATENT DOCUMENTS

| | | | |
|---|---|---|---|
| 2014/0072335 | A1 | 3/2014 | Fukui |
| 2014/0072339 | A1 | 3/2014 | Munetsugu |
| 2017/0068210 | A1 | 3/2017 | Maeshima |

IMAGE FORMING APPARATUS

CROSS REFERENCE OF RELATED APPLICATION

The disclosure of Japanese patent application No. 2015-182434 filed on Sep. 16, 2015 is incorporated by reference.

This is a continuation of U.S. application Ser. No. 15/262,720, filed on Sep. 12, 2016, the entire disclosure of which is incorporated herein by reference.

BACKGROUND OF THE INVENTION

Field of the Invention

The present invention relates to an image forming apparatus, and more specifically, an image forming apparatus that a developing unit having a developing roller is made insertable or extractable in a longitudinal direction to or from a developing unit attaching portion provided in an apparatus main body.

Description of the Related Art

Conventionally, an image forming apparatus that a photoreceptor unit comprising a photoreceptor drum (electrostatic latent image bearing member) and a developing unit having a developing roller are individually insertable or extractable to or from an apparatus main body is known. In such an image forming apparatus, it is necessary to bring the photoreceptor drum and the developing roller close to each other at the time of image forming, whereas it is necessary to guide the developing unit so as to be moved on a position departed from the photoreceptor drum at the time of inserting the developing unit into an apparatus main body in order to prevent the developing unit from being brought into contact to the photoreceptor drum and thus damaging the photoreceptor drum. In the conventional image forming apparatus, when arranging the developing roller in a position close to the horizontal direction with respect to the photoreceptor drum, the photoreceptor drum and the developing unit are made to be separated from each other by performing parallel moving of the developing unit to an approximately horizontal direction from a normal position. However, this requires a large space in the horizontal direction in order to ensure a space between the developing unit and the photoreceptor drum, there is a problem that the apparatus main body becomes large.

On the other hand, there is disclosed in Japanese patent application laying-open No. 2015-82056 [G03G 15/18, G03G 21/00, G03G 15/00] (patent literature 1) an image forming apparatus comprising a developing unit movable around a rocking shaft between a contacting position and a separated position with respect to a photoreceptor unit in a state where the developing unit is attached to an apparatus main body. In the image forming apparatus of the patent literature 1, the developing unit is made a state where the developing unit is inclined so as to be separated from the photoreceptor drum at the time of insertion of the developing unit into the apparatus main body. Then, by turning a control lever after completion of the insertion of the developing unit, a turning mechanism of the developing unit is operated, thereby bringing the developing unit into contact with the photoreceptor drum.

However, in the image forming apparatus of the patent literature 1, in order to turn the developing unit with using the turning mechanism interlocked with the control lever, it requires a number of components and a cost. Furthermore, since it is necessary to perform separately an operation of inserting the developing unit into the apparatus main body and an operation of turning the developing unit after completion of insertion, an operation burden on a user increases.

SUMMARY OF THE INVENTION

Therefore, it is a primary object of the present invention to provide an image forming apparatus capable of reducing a size of an apparatus main body and the number of components.

A first invention is an image forming apparatus comprising a developing unit having a developing roller that supplies a toner to an electrostatic latent image bearing member, and a developing unit attaching portion provided in an apparatus main body, to or from which the developing unit is insertable or extractable along a longitudinal direction, characterized in that the image forming apparatus further comprises an insertion guide that makes the developing unit a state where the developing unit is inclined from a normal posture so as to be moved on a position departed from the electrostatic latent image bearing member during a period from a start of insertion of the developing unit into the developing unit attaching portion until just before completion of the insertion, and makes, during a period from just before completion of the insertion until completion of the insertion, the developing unit turn according to an insertion operation of the developing unit so as to be brought close to the photoreceptor drum, whereby the developing unit is positioned so as to take the normal posture.

In the first invention, the image forming apparatus comprises the developing unit having the developing roller, which is made attachable or detachable (insertable or extractable) in a longitudinal direction to or from the developing unit attaching portion that is provided in the apparatus main body. Furthermore, the image forming apparatus comprises the insertion guide that is constituted by a projection(s), a groove(s), etc., and by using this insertion guide, the developing unit is made a state where the developing unit is inclined from the normal posture (position) so as to be moved on the position departed from the electrostatic latent image bearing member such as a photoreceptor drum during a period from a start of the insertion of the developing unit to the developing unit attaching portion until just before completion of the insertion. Then, during a period from just before completion of the insertion until completion of the insertion, the insertion guide makes the developing unit turn according to an insertion operation of the developing unit so as to be brought close to the photoreceptor drum, whereby the developing unit is positioned so as to take the normal posture.

According to the first invention, since the developing unit is guided with using the insertion guide so as to be inserted in a state where it is inclined from the normal posture, it is possible to ensure a distance between the developing unit and the electrostatic latent image bearing member without using a space in a horizontal direction not much. Furthermore, since the developing unit can be positioned so as to take the normal posture with using the insertion guide, it is not necessary to provide separately with a turning mechanism of the developing unit interlocked with a control lever etc. Therefore, it is possible to reduce a size of the image forming apparatus, and prevent increase of the number of components.

A second invention is the image forming apparatus according to the first invention. In the second invention, during a period from the start of the insertion until just before completion of the insertion, the insertion guide guides the developing unit so that the developing unit is moved on the position deviated below while making the developing unit a state the developing unit is inclined form the normal posture. Then, during a period from just before completion of the insertion until the completion of the insertion, the insertion guide makes the developing unit turn while lifting the same, whereby the developing unit is positioned so as to take the normal posture. Accordingly, it is possible to more adequately ensure the distance between the developing unit and the electrostatic latent image bearing member without using a space in the horizontal direction at the time of insertion of the developing unit.

A third invention is the image forming apparatus according to the first invention. In the third invention, the insertion guide has a guide groove(s) and a guide projection(s) that are fit to each other in a slidable manner. As an example, the guide groove(s) includes a first guide groove and a second guide groove that are provided on both outer side surfaces of the developing unit, respectively, and the guide projection(s) includes a first guide projection and a second guide projection that are provided on both inner side surfaces of the developing unit attaching portion, respectively, and fit to the first guide groove and the second guide groove, respectively.

A fourth invention is the image forming apparatus according to the first invention. In the fourth invention, the insertion guide has a first front end pushing-up portion and a first rear end pushing-up portion each formed in a shape of projection having an inclined surface. The first front end pushing-up portion is provided on the developing unit attaching portion in an end portion of the back side of the insertion direction of the developing unit and a side portion opposite to the electrostatic latent image bearing member. Furthermore, the first rear end pushing-up portion is provided on the developing unit in an end portion of this side of the insertion direction of the developing unit and the side portion opposite to the electrostatic latent image bearing member.

A fifth invention is the image forming apparatus according to the fourth invention. In the fifth invention, the insertion guide has a second front end pushing-up portion and a second rear end pushing-up portion each formed in a shape of projection having an inclined surface. The second front end pushing-up portion is provided on the developing attaching portion in an end portion of the back side of the insertion direction of the developing unit and a side portion in a side of the electrostatic latent image bearing member. Furthermore, the second rear end pushing-up portion is provided on the developing unit in an end portion of this side of the insertion direction of the developing unit and the side portion in a side of the electrostatic latent image bearing member.

The above mentioned objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

[First Embodiment]

Figure 1:
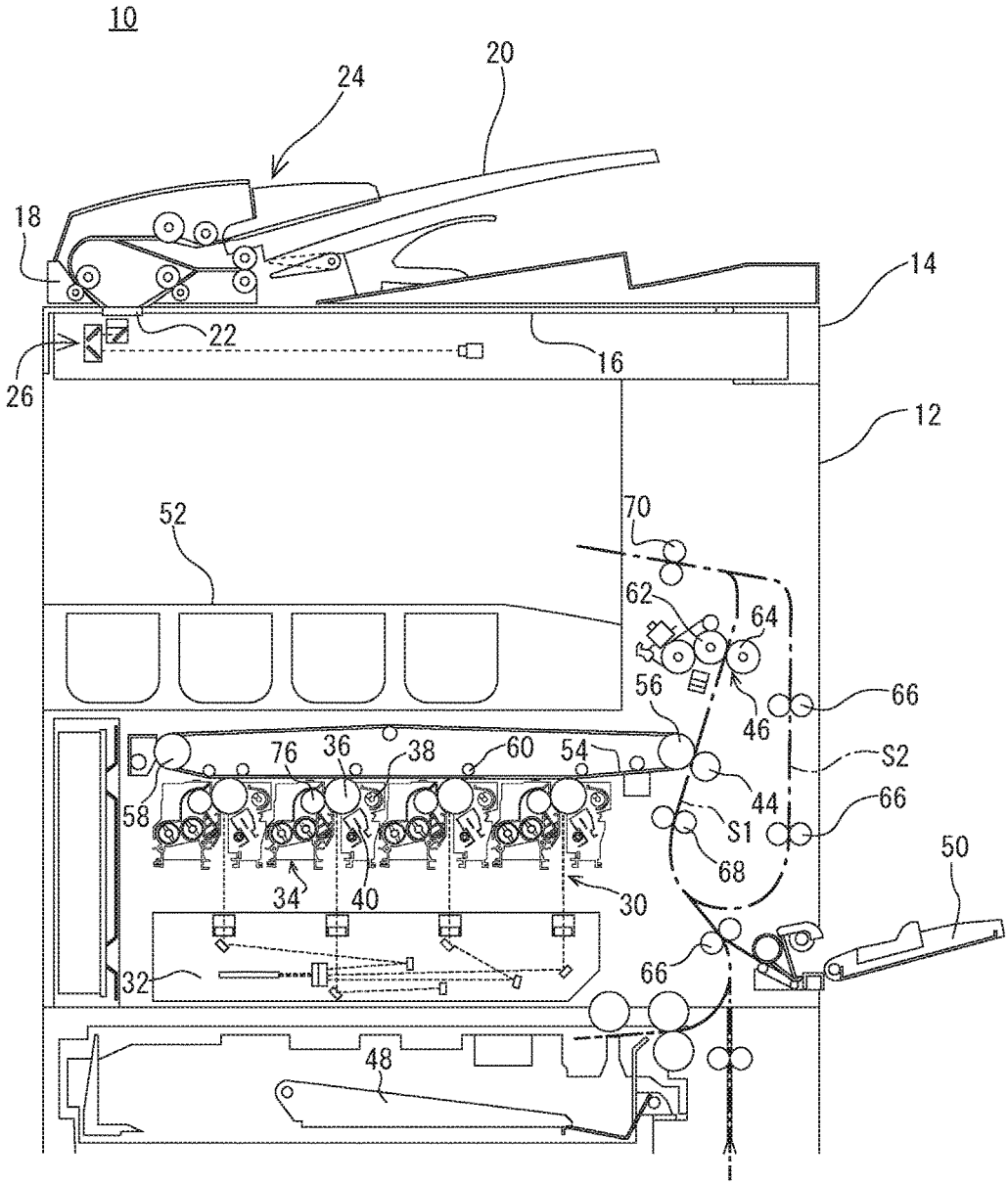
FIG. 1 is a schematically sectional view showing internal structure of an image forming apparatus according to a first embodiment of the present invention.

FIG. 1 is a schematic structure view viewing an entire image forming apparatus 10 that is an embodiment of the present invention from the front.

With referring to FIG. 1, the image forming apparatus 10 of the first embodiment is a multifunction peripheral (MFP) that has a copying function, a printer function, a scanner function, a facsimile function, etc., and forms a multicolor or monochromatic image on a paper (recording medium) with an electrophotographic system. As described later in detail, the image forming apparatus 10 comprises a photoreceptor unit comprising a photoreceptor drum 36 etc., and a developing unit 34 comprising a developing roller 76 etc., and the photoreceptor unit and the developing unit 34 are individually attachable or detachable (insertable or extractable) to or from an apparatus main body 12 of the image forming apparatus 10.

First, basic structure of the image forming apparatus 10 will be schematically described. As shown in FIG. 1, the image forming apparatus 10 comprises the apparatus main body 12 comprising an image forming portion 30 etc., and an image reading apparatus 14 that is arranged above thereof.

The image reading apparatus 14 comprises an original platen 16 formed of transparent material. A platen cover 18 is attached above the original platen 16 via a hinge etc. so as to be opened and closed freely. This platen cover 18 is provided with an ADF (Automatic Document Feeder) 24 that automatically feeds an original put on an original tray 20 one by one to an image reading position 22. Furthermore, although an illustration is omitted, on a front side of the original platen 16, there is provided with an operating portion such as a touch panel, an operation button, etc. which receive an input operation by a user.

Furthermore, the image reading apparatus 14 is incorporated with an image scanner 26 that comprises a light source, a plurality of mirrors, a focusing lens, a line sensor, etc. The image scanner 26 exposes a surface of an original by the light source, and leads a reflected light that is reflected from the surface of the original to the focusing lens by the plurality of mirrors. Then, the reflected light is focused onto photoreceptor elements of the line sensor by the focusing lens. The line sensor detects brightness and chromaticity of the reflected light that is focused onto the photoreceptor elements, and produces image data based on an image of the original surface. As the line sensor, a CCD (Charge Coupled Device), a CIS (Contact Image Sensor) or the like may be used.

The apparatus main body 12 is incorporated with a control portion (not shown) including a CPU, a memory, etc., an image forming portion 30, etc. The control portion transmits control signals to respective components or portions of the image forming apparatus 10 according to the input operation to the operating portion such as the touch panel or the like so as to make the image forming apparatus 10 perform various kinds of operations or actions.

The image forming portion 30 comprises an exposure unit 32, a developing unit 34, a photoreceptor drum 36, a cleaner unit 38, a charger 40, an intermediate transfer belt unit 42, a transfer roller 44, a fixing unit 46, etc., and forms an image on a paper that is fed from a paper feeding tray 48 or a manual paper feeding tray 50, and discharges a paper having been formed with the image onto a paper discharge tray 52. As image data for forming an image on a paper, image data read by the image scanner 26, image data transmitted from an external computer, etc. can be utilized.

In addition, image data treated in the image forming apparatus 10 corresponds to a color image of four (4) colors of black (K), cyan (C), magenta (M) and yellow (Y). Therefore, the developing unit 34, the photoreceptor drum 36, the cleaner unit 38 and the charger 40 are respectively provided by four (4) so that four (4) kinds of latent images corresponding to respective colors can be formed, and four (4) image stations are established by these components. The four (4) image stations are arranged in one line in a horizontal direction along a running direction of a surface of an intermediate transfer belt 54. Furthermore, the photoreceptor drum 36, the cleaner unit 38 and the charger 40 are unitized, and these components constitute a photoreceptor unit. The developing unit 34 and the photoreceptor unit are made to be individually insertable or extractable to or from the apparatus main body 12 at the front side thereof.

The photoreceptor drum 36 is a latent image bearing member that a photosensitive layer is formed on a surface of a cylindrical substrate having conductivity, and made rotatable about an axis line by a driving portion (not shown). However, it is possible to use a photoreceptor belt instead of the photoreceptor drum 36 as the electrostatic latent image bearing member. The charger 40 is a member for charging a surface of the photoreceptor drum 36 at a predetermined electric potential. Furthermore, the exposure unit 32 is constituted as a laser scanning unit (LSU) that comprises a laser emitting portion and reflecting mirrors, etc., and exposes the surface of the photoreceptor drum 36 having been charged, thereby forming an electrostatic latent image according to image data on the surface of the photoreceptor drum 36. The cleaner unit 38 removes and collects a toner that remains on the surface of the photoreceptor drum 36 after transfer of a toner image onto the intermediate transfer belt 54.

The developing unit 34 visualizes the electrostatic latent image that is formed on the surface of the photoreceptor drum 36 with toners of four (4) colors (YMCK) (forms toner images), and comprises a developing roller 76 etc. that supply a toner to the photoreceptor drum 36. The developing roller 76 is arranged in a position close to a horizontal direction with respect to the photoreceptor drum 36, and is made rotatable by a driving portion (not shown) about an axis line. Furthermore, a developer (two-component developer) that includes a toner and a carrier is stored in a developer vessel 80 of the developing unit 34, and the toner included in this developer is supplied to the photoreceptor drum 36 via the developing roller 76. Specific structure of the developing unit 34 will be described later.

The intermediate transfer belt unit 42 comprises an intermediate transfer belt 54, a driving roller 56, a driven roller 58, four (4) intermediate transfer rollers 60, etc., and is arranged above the photoreceptor drum 36. The intermediate transfer belt 54 is provided so as to be brought into contact with respective photoreceptor drums 36, and a multicolor toner image can be formed on the intermediate transfer belt 54 by sequentially transferring respective color toner images formed on the respective photoreceptor drums 36 onto the intermediate transfer belt 54 in an overlapped manner. Furthermore, the transfer roller 44 is arranged near the driving roller 56, and when a paper passes through a nip region between the intermediate transfer belt 54 and the transfer roller 44, the toner image formed on the intermediate transfer belt 54 is transferred onto the paper.

The fixing unit 46 comprises a heat roller 62 and a pressure roller 64, and is arranged above the transfer roller 44. The heat roller 62 is set to be a predetermined fixing temperature, and when a paper passes a nip region between the heat roller 62 and the pressure roller 64, the toner image that is transferred onto the paper is melted, mixed and pressured, whereby the toner image can be heat-fixed on the paper.

Within such the apparatus main body 12, there is formed with a first paper path S1 for feeding a paper from a paper feeding tray 48 or a manual paper feeding tray 50 to a paper discharge tray 52 via a resist roller 68, the transfer roller 44 and the fixing unit 46. Furthermore, there is formed with a second paper feeding path S2 for returning a paper after passing the fixing unit 46 while having completed simplex printing to the first paper path S1 in an upstream side of a paper feeding direction by the transfer roller 44 when performing duplex printing onto the paper. A plurality of feeding rollers 66 for auxiliarily applying a propulsive force to a paper are suitably provided in these first paper feeding path S1 and second feeding paper path S2.

When performing simplex printing in the apparatus main body 12, a paper put on the paper feeding tray 48 or the manual paper feeding tray 50 is led one by one to the first paper path S1, and fed by the feeding rollers 66 to the resist roller 68. Then, the paper is fed to the transfer roller 44 at a timing that a tip end of the paper and a tip end of the toner image on the intermediate transfer belt 54 are aligned with each other by the resist roller 68, whereby the toner image can be transferred onto the paper. Thereafter, an unfixed toner on the paper is melted and fixed when the paper passes through the fixing unit 46, and the paper is discharged on the paper discharge tray 52 via the paper discharge rollers 70.

On the other hand, if duplex printing is to be performed, by reversely rotating the paper discharge rollers 70 when a tail end of the paper that simplex printing is completed and passes through the fixing unit 46 reaches the paper discharge rollers 70 near the paper discharge tray 52, the paper is fed backward so as to be led to the second paper feeding path S2. The paper led to the second paper path S2 is fed in the second paper feeding path S2 by the paper feeding rollers 66, and is further led to the first paper path S1 in the upstream side of a paper feeding direction from the resist roller 68. Since the back and front of the paper is reversed at this time, when the paper passes the secondary transfer roller 44 and the fixing unit 46 after that, printing is performed on the back of the paper.

In such an image forming apparatus 10, the developing roller 76 has to be arranged in a manner that an outer surface thereof is brought close to an outer surface of the photoreceptor drum 36 at the time of image forming, that is, in a normal attaching state where attaching of the developing unit 34 to the apparatus main body 12 is completed. On the other hand, in order to prevent the developing unit 34 from being brought into contact with the photoreceptor drum 36 and thus damaging it, the developing unit 34 has to be guided so as to be moved on a position departed from the photoreceptor drum 36 at the time of insertion of the developing unit 34 into the apparatus main body 12. At this time, it is desirable to be able to suppress increase in a size of the apparatus main body 12 and increase in the number of components. Accordingly, in this first embodiment, following structure is adopted in the developing unit 34 and the developing unit attaching portion 102 that is provided in the apparatus main body 12.

Figure 2:
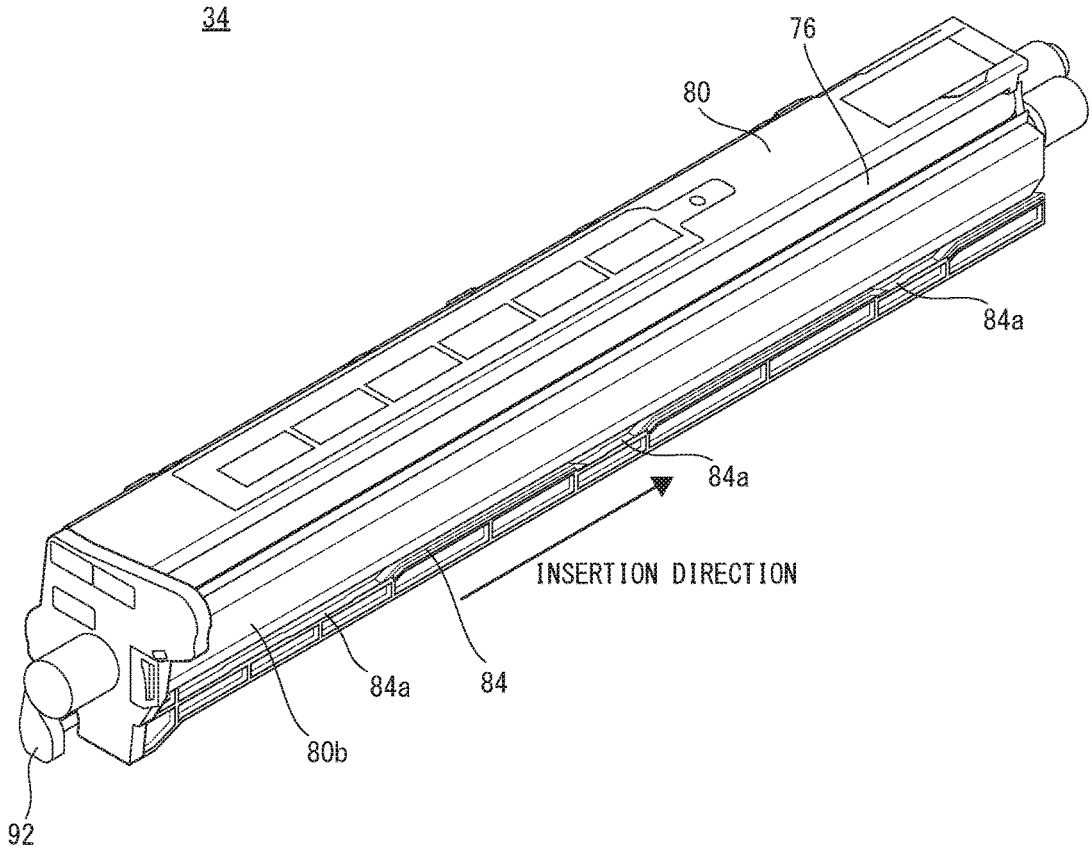
FIG. 2 is a perspective view showing a developing unit provided in the image forming apparatus of FIG. 1.
Figure 3:
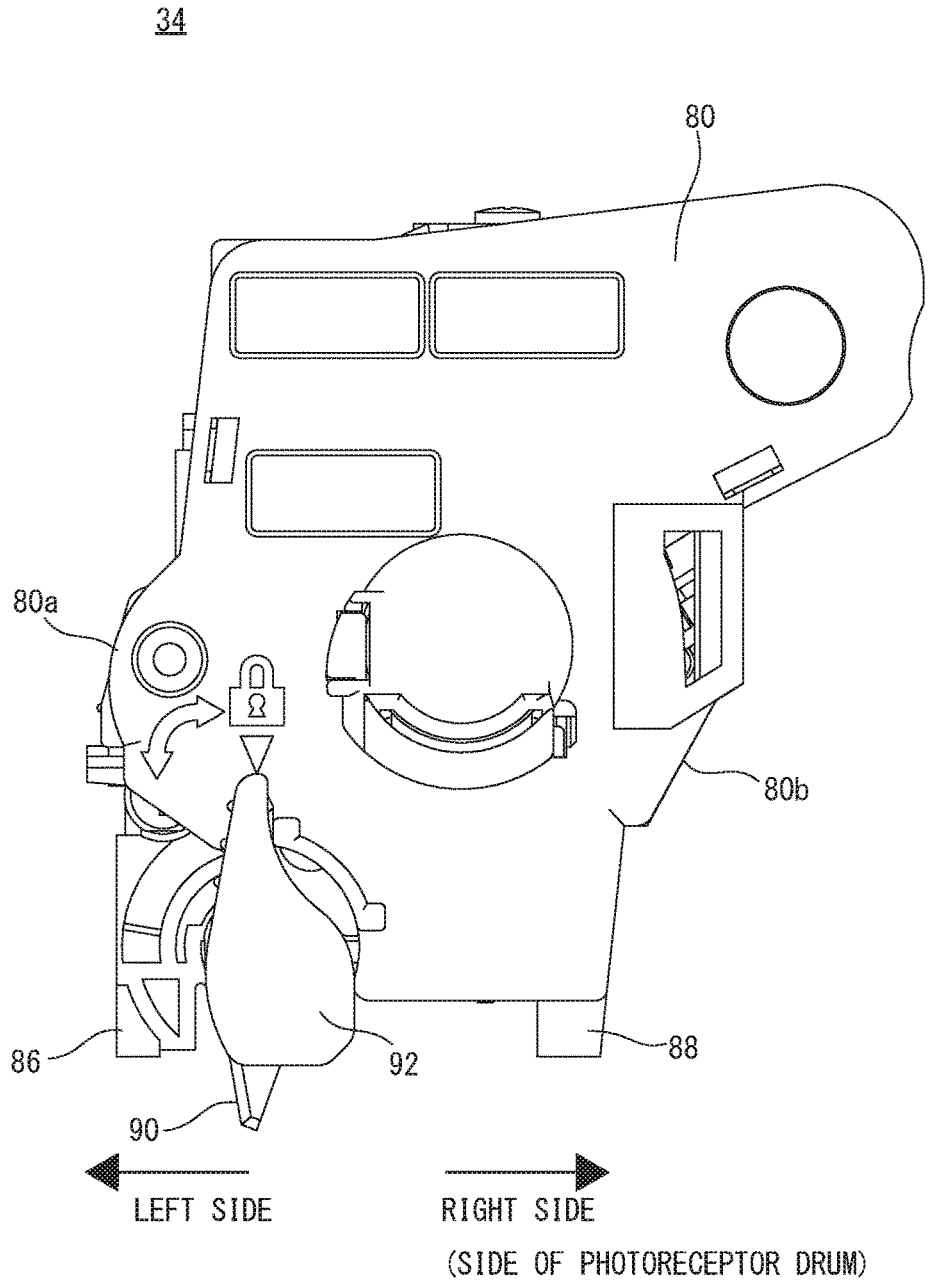
FIG. 3 is an illustration view showing an end surface of this side of an insertion direction of the developing unit of FIG. 2.
Figure 4:
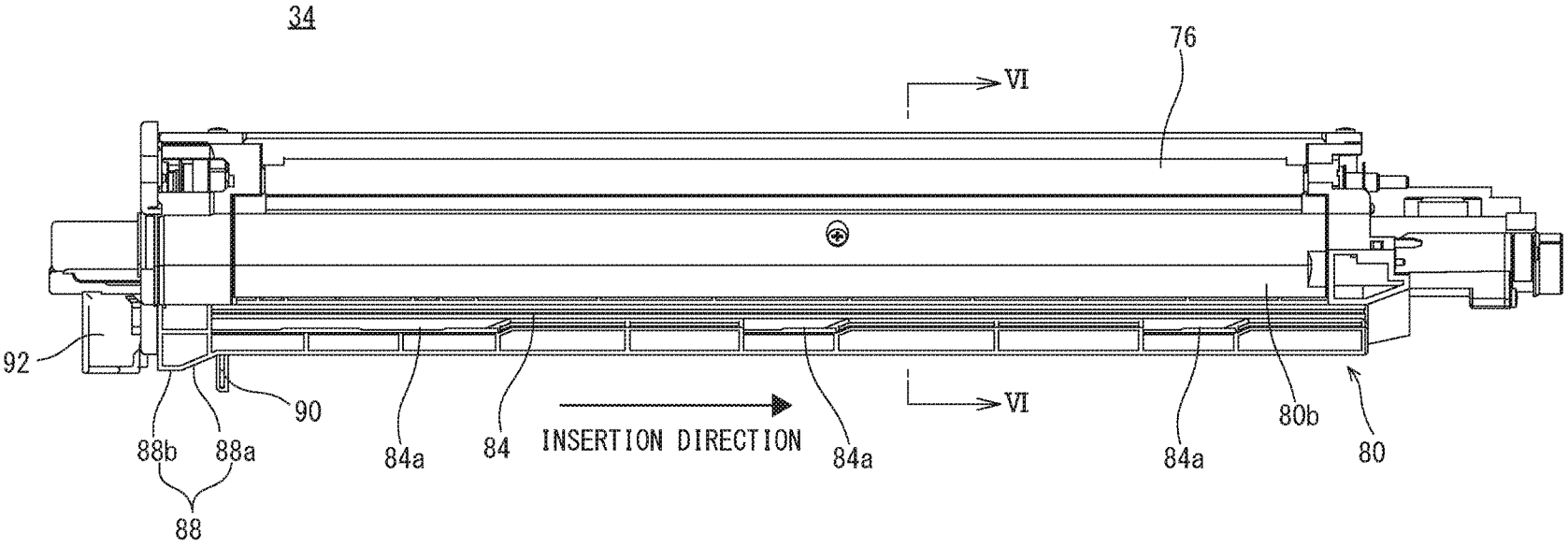
FIG. 4 is an illustration view showing a side surface in a right side toward the insertion direction of the developing unit of FIG. 2.
Figure 5:
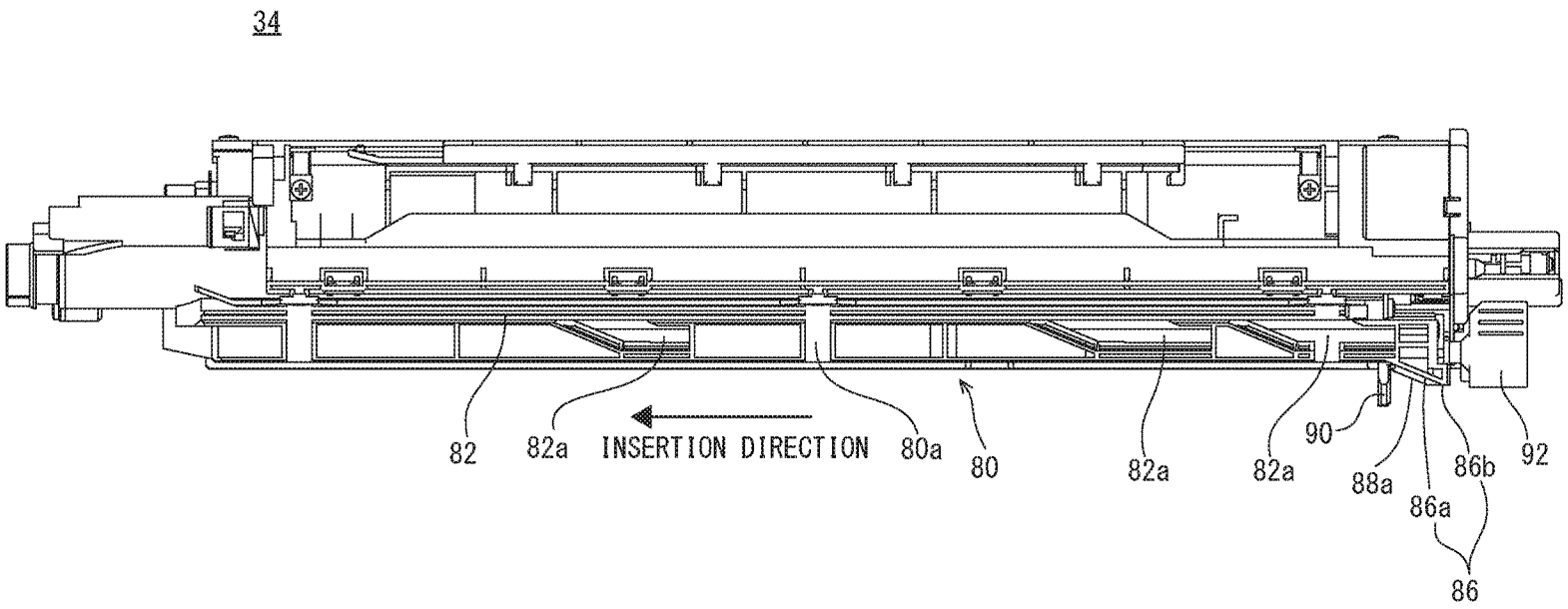
FIG. 5 is an illustration view showing a side surface in a left side toward the insertion direction of the developing unit of FIG. 2.
Figure 6:
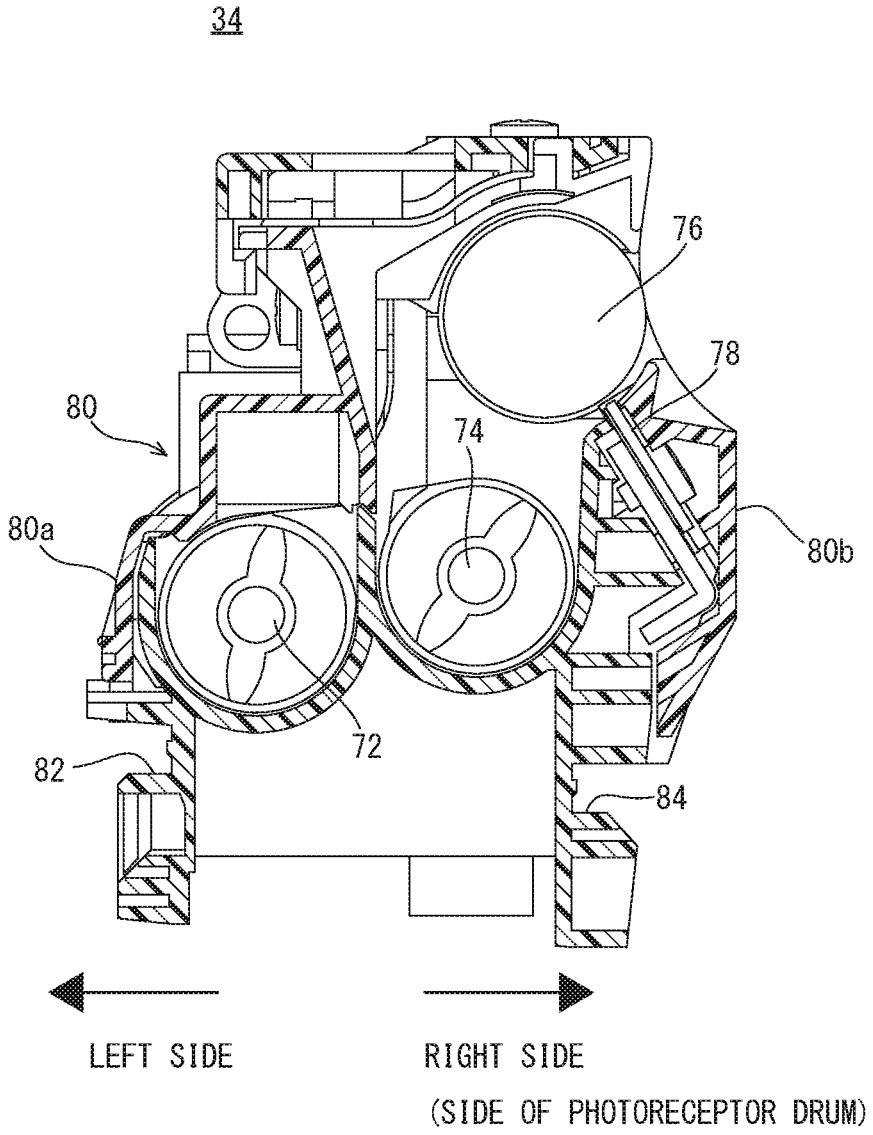
FIG. 6 is a sectional view showing a section of the developing unit at a line VI-VI in FIG. 4.

In the following, with reference to FIG. 2-FIG. 6, the structure of the developing unit 34 will be described. FIG. 2 is a perspective view showing a manner that the developing unit 34 is viewed obliquely from the above, and FIG. 3 is an illustration view showing an end surface of this side of an insertion direction of the developing unit 34 (front side of the apparatus main body 12). Furthermore, FIG. 4 is an illustration view showing a side surface in a right side (side of photoreceptor drum 36) toward the insertion direction of the developing unit 34, and FIG. 5 is an illustration view showing an opposite side to FIG. 4, that is, a side surface in a left side toward the insertion direction of the developing unit 34. Furthermore, FIG. 6 is a sectional view showing a section of the developing unit 34 at a line VI-VI line of FIG. 4.

As shown in FIG. 2-FIG. 6, the developing unit 34 comprises a first transporting member 72, a second transporting member 74, a developing roller 76, a doctor blade 78, etc., and these are integrally held by a developer vessel 80 in a predetermined arrangement manner.

Specifically, in an inside of the developer vessel 80, there are provided with the first transporting member 72 and the second transporting member 74 in a manner that respective rotation axes are in parallel with each other, and a developer that a toner and a carrier are mixed is stored. Each of the first transporting member 72 and the second transporting member 74 is an auger screw that a spiral blade is formed on an outer periphery surface of a cylindrical rotation axis (screw shaft). The first transporting member 72 and the second transporting member 74 transport the developer while churning so as to circulate the developer in a predetermined direction in the developer vessel 80.

Furthermore, the developing roller 76 is arranged above the second transporting member 74 in the developer vessel 80. The developing roller 76 is a magnet roller that functions as a developer carrying member, and arranged in a position near a horizontal direction with respect to the photoreceptor drum 36 in a manner that respective rotation axes are aligned in parallel with each other and respective outer periphery surfaces are brought close to each other. The developing roller 76 carries the developer within the developer vessel 80 on its outer surface and supplies a toner included in the carried developer onto the outer surface of the photoreceptor drum 36, whereby an electrostatic latent image formed on the surface of the photoreceptor drum 36 can be visualized.

Furthermore, the doctor blade 78 is fixed in the developer vessel 80 so as to have a predetermined gap to the surface of the developing roller 76. The doctor blade 78 is a tabular member extended in a direction of an axis line of the developing roller 76. A quantity of the developer carried by the developing roller 76 is regulated by a predetermined quantity by this doctor blade 78.

Then, as well shown in FIG. 4-FIG. 6, the developing vessel 80 is formed with guide grooves 82 and 84 and rear end pushing-up portions 86 and 88. The guide grooves 82 and 84 and the rear end pushing-up portions 86 and 88 constitute an insertion guide at the time of attaching the developing unit 34 to a developing unit attaching portion 102.

The guide grooves 82 and 84 are formed in lower parts of both outer side surfaces 80*a* and 80*b* of the developer vessel 80. More specifically, a first guide groove 82 is formed in a lower part of a left outer side surface 80*a* that is a side surface in a left side toward the insertion direction of the developing unit 34, and a second guide groove 84 is formed in a lower part of a right outer side surface 80*b* that is an opposite side thereto.

Each of the first guide groove 82 and the second guide groove 84 is formed so as to be extended in a form of a straight line along the axis direction of the developing roller 76, that is, a longitudinal direction (the insertion direction) of the developing unit 34. Furthermore, the second guide groove 84 is formed in a position lower than a height position of the first guide groove 82 in a state where the developing unit 34 is upright, that is, a state where the developing unit 34 takes a normal posture. Furthermore, in the first guide groove 82 and the second guide groove 84, there are formed with evacuating portions 82*a* and 84*a* for allowing movements of the guide projections 110 and 112 (see FIG. 7) with respect to a width direction (vertical direction) of the guide grooves 82 and 84 when performing positioning of the developing unit 34 into the normal posture by turning the developing unit 34 just before completion of insertion from its inclined state. The evacuating portions 82*a* and 84*a* may be formed by widening groove widths of the guide grooves 82 and 84 or providing a branch groove, for example.

The rear end pushing-up portions 86 and 88 are formed in a bottom portion of the developer vessel 80 in a rear end side of the insertion direction of the developing unit 34 (this side of the insertion direction, that is, a front side of the apparatus main body 12). That is, a first rear end pushing-up portion 86 is formed in a left side toward the insertion direction of the developing unit 34, that is, a lower end of a left side wall of the developer vessel 80, which is located in an opposite side to the photoreceptor drum 36. Furthermore, a second rear end pushing-up portion 88 is formed in a right side toward the insertion direction of the developing unit 34, that is, a lower end of a right side wall of the developer vessel 80, which is located in the same side as the photoreceptor drum 36.

The first rear end pushing-up portion 86 and the second rear end pushing-up portion 88 respectively include projections downwardly protruded from the lower end of the developer vessel 80, which having inclined surfaces 86*a* and 88*a* that are inclined in a manner that projection heights thereof become higher toward the rear end side of the insertion direction of the developing unit 34, and horizontally flat surfaces 86*b* and 88*b* formed in a rear end side of the inclined surfaces 86*a* and 88*a*. An inclination angle of the inclined surface 86*a* of the first rear end pushing-up portion 86 is the same or approximately the same as an inclination angle of the inclined surface 88*a* of the second rear end pushing-up portion 88. Furthermore, the inclined surface 86*a* of the first rear end pushing-up portion 86 starts an inclination from a frond end side of insertion direction of the developing unit 34 and finishes the inclination at a rear end side of the insertion direction of the developing unit 34 than the inclined surface 88*a* of the second rear end pushing-up portion 88. That is, the inclined surface 86*a* of the first rear end pushing-up portion 86 has a longer length in the insertion direction of the developing unit 34 and a larger height difference form a lower end to an upper end thereof in comparison with those of the inclined surface 88*a* of the second rear end pushing-up portion 88.

Furthermore, the developer vessel 80 is formed in a manner that a height position of the lower end of the left side wall is lower than a lower end of the right side wall throughout approximately full length of the longitudinal direction in a state where the developing unit 34 takes the normal posture. Accordingly, the lower end of the left side wall of the developer vessel 80 is not too much protruded downward when the developing unit 34 is inclined from the normal posture as described later.

Furthermore, a stopper 90 is rotatably provided in an end of the rear end side of the insertion direction of the developing unit 34 on the bottom portion of the developer vessel 80. The stopper 90 prevents a motion of the developing unit 34 in the longitudinal direction thereof after completion of insertion of the developing unit 34, and a lock lever 92 is coupled with the stopper 90 via a coupling shaft that is extended in the longitudinal direction of the developing unit 34. The stopper 90 can be turned, according to a turning operation of the lock lever 92, between a lock position where the stopper 90 is protruded from the lower end of the rear end pushing-up portions 86 and 88 and an unlock position where the stopper 90 is retracted above the lower end of the rear end pushing-up portions 86 and 88.

On the other hand, the developing unit attaching portion 102 is formed on the main body frame 100 that is provided in the apparatus main body 12. The above-described developing unit 34 is attached to the developing unit attaching portion 102 from the front side of the apparatus main body 12 in an insertable or extractable manner, and inserted into the inside of the apparatus main body 12 or withdrawn from the apparatus main body 12 by being slid on the developing unit attaching portion 102.

Figure 7:
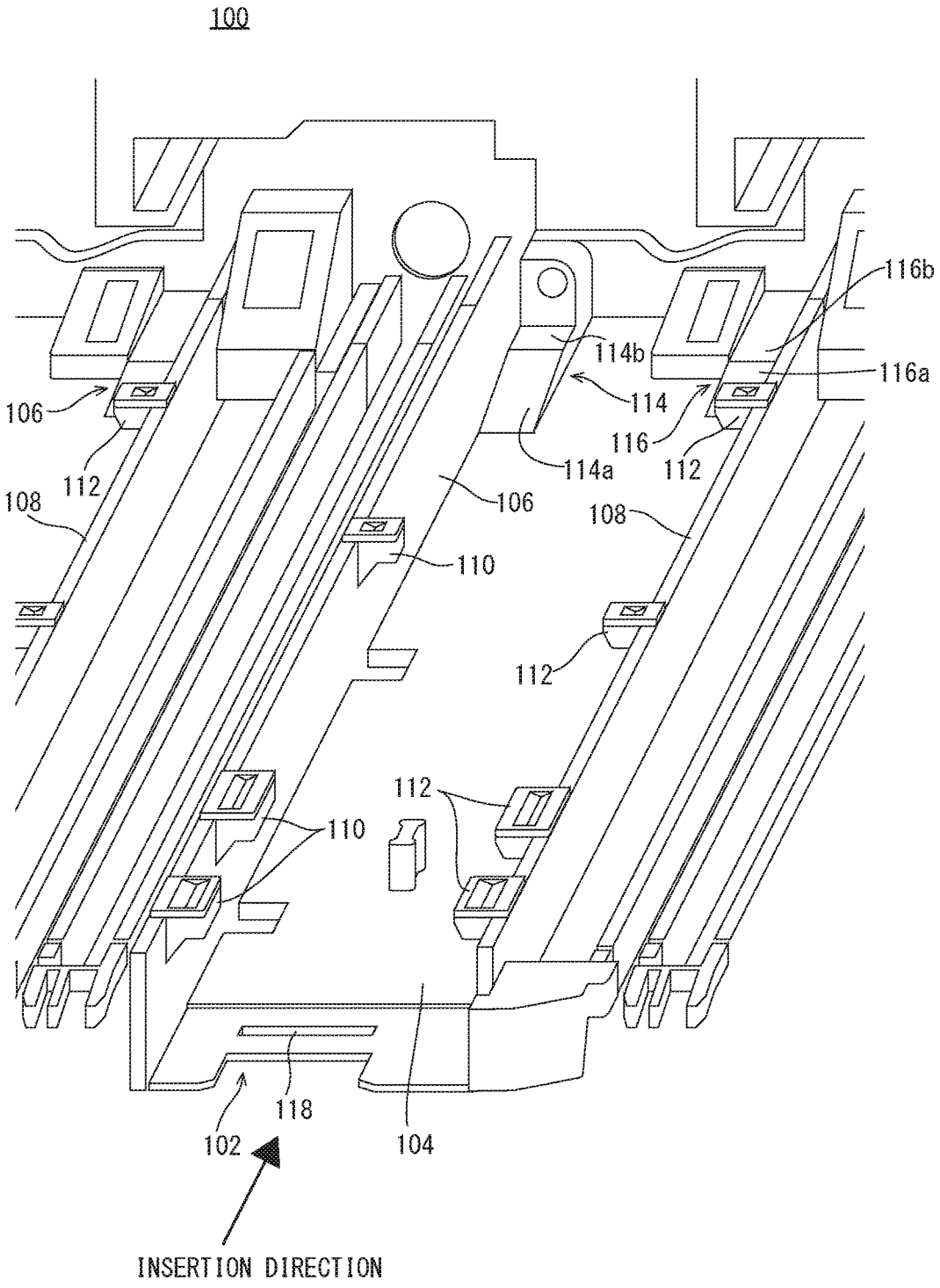
FIG. 7 is a perspective view showing a developing unit attaching portion provided in an apparatus main body of the image forming apparatus of FIG. 1.
Figure 8:
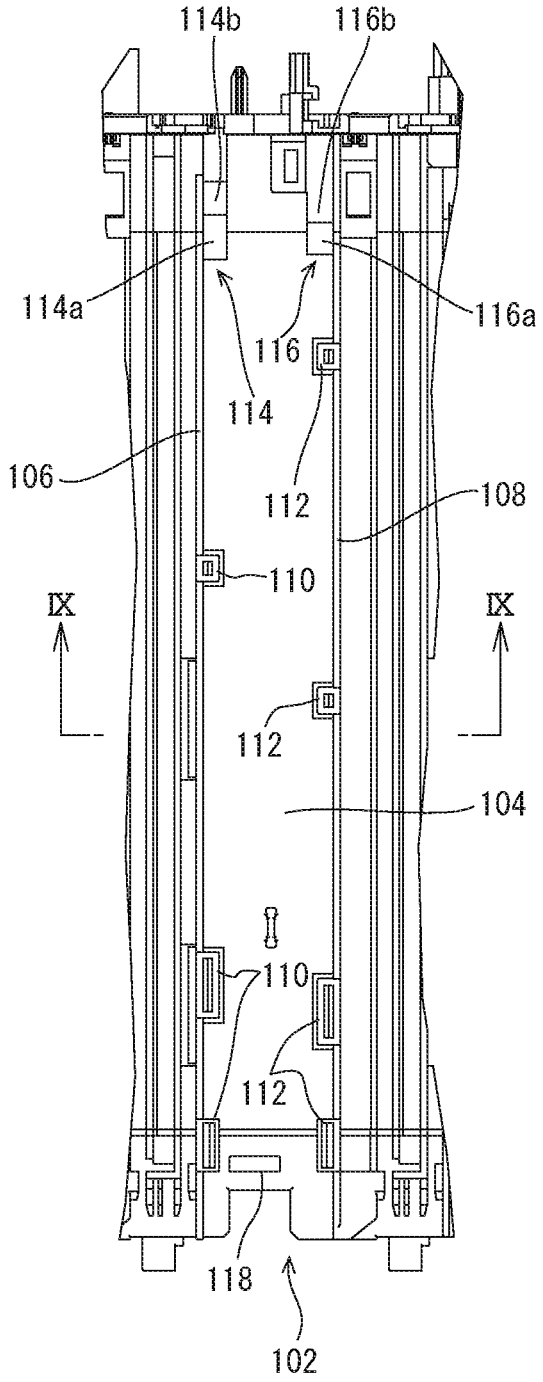
FIG. 8 is a plan view showing the developing unit attaching portion of FIG. 7.

In the following, with reference to FIG. 7-FIG. 9, structure of the developing unit attaching portion 102 will be described. FIG. 7 is a perspective view showing a manner that the developing unit attaching portion 102 is obliquely viewed from the above, and FIG. 8 is a plan view showing the developing unit attaching portion 102. Furthermore, FIG. 9 is a sectional view showing a section of the developing unit attaching portion 102 at a line IX-IX in FIG. 8.

Figure 9:
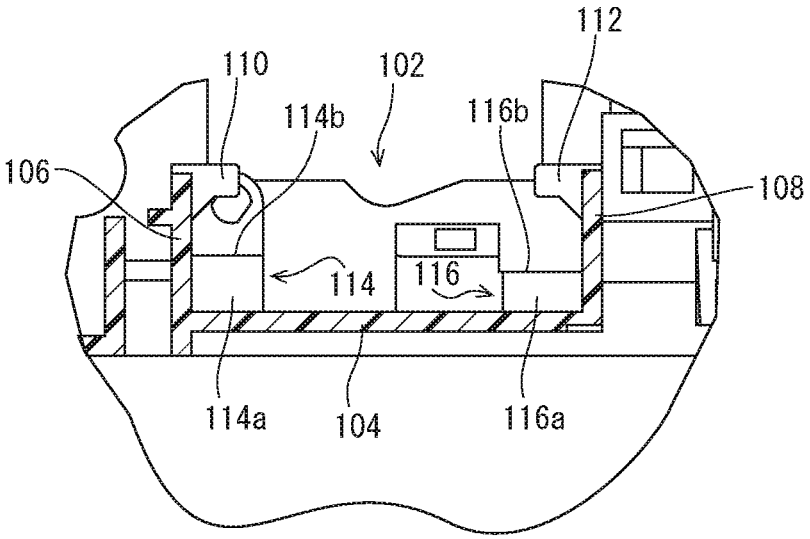
FIG. 9 is a sectional view showing a section of the developing unit attaching portion at a line IX-IX in FIG. 8.

As shown in FIG. 7-FIG. 9, the developing unit attaching portion 102 includes a rectangular plate-like bottom wall 104 and side walls 106 and 108 rising upward from both side portions of the bottom wall 104, and is formed in a shape of groove-like extending in a form of a straight line in a front and rear direction of the apparatus main body 12.

Furthermore, the guide projections 110 and 112 and front end pushing-up portions 114 and 116 are formed on the developing unit attaching portion 102. The guide projections 110 and 112 and the front end pushing-up portions 114 and 116 constitute an insertion guide at the time of attaching the developing unit 34 to the developing unit attaching portion 102.

The guide projections 110 and 112 are projections that are fit to the above-described guide grooves 82 and 84 in a slidable manner, and formed so as to be protruded inwardly from upper end portions of the both side walls 106 and 108. That is, a first guide projection 110 that is fit to the first guide groove 82 is provided on an upper end portion of the left side wall 106 that is a wall of a left side toward the insertion direction of the developing unit 34 (i.e., viewing from the front side of the apparatus main body 12). Furthermore, a second guide projection 112 that is fit to the second guide groove 84 is provided on an upper end portion of the right side wall 108 that is a wall of a right side toward the insertion direction of the developing unit 34.

Each of the first guide projection 110 and the second guide projection 112 is constituted by a plurality of projections, each having a shape of an approximately rectangular parallelepiped, arranged at predetermined intervals along the insertion direction of the developing unit 34. The first guide projection 110 and the second guide projection 112 are formed in the same or approximately the same height position.

Furthermore, the first guide projection 110 and the second guide projection 112 that are located in the nearest this side of the insertion direction of the developing unit 34 are provided so that positions of the front and rear direction thereof become the same (that is, line up parallel in right and left), and the first guide projection 110 and the second guide projection 112 that are located in the back side from them are provided in positions deviated in the front and rear direction. By lining-up the first guide projection 110 and the second guide projection 112 located in the nearest this side parallel in right and left, it becomes easy to fit the guide projections 110 and 112 to the guide grooves 82 and 84 at the time of a start of insertion of the developing unit 34. Furthermore, by deviating the first guide projection 110 and the second guide projection 112 in the front and rear direction, it is possible to effectively prevent, with a small number of projections, a tip portion of the developing unit 34 from being swung at the time of the insertion of the developing unit 34.

Furthermore, as for the guide projections 110 and 112, one located in this side of the insertion direction of the developing unit 34 is made wider than another one located in the back side. Accordingly, in sliding the guide projections 110 and 112 with respect to the guide grooves 82 and 84, it is possible to prevent the guide projections 110 and 112 from entering into the evacuating portions 82*a* and 84*a* located in this side nearer from an intended position.

The front end pushing-up portions 114 and 116 are formed on a bottom portion of the developing unit attaching portion 102 in an end portion of the back side of the insertion direction of the developing unit 34 (that is, a rear surface side of the apparatus main body 12). That is, a first front end pushing-up portion 114 is formed in a side of a left side wall 106 of the bottom wall 104 of the developing unit attaching portion 102, that is, an upper surface of a side portion opposite to the photoreceptor drum 36. Furthermore, a second front end pushing-up portion 116 is formed in a side of a right side wall 108 of the bottom wall 104 of the developing unit attaching portion 102, that is, an upper surface of the same side portion as the photoreceptor drum 36.

The first front end pushing-up portion 114 and the second front end pushing-up portion 116 respectively include projections that are protruded upward from an upper surface of the bottom wall 104 of the developing unit attaching portion 102, and have inclined surfaces 114*a* and 116*a* each inclined so that a protruding height becomes higher toward the back side of the insertion direction of the developing unit 34, and horizontally flat surfaces 114*b* and 116*b* each formed in the back side deeper than them. An inclination angle of the inclined surface 114*a* of the first front end pushing-up portion 114 is the same or approximately the same as an inclination angle of the inclined surface 116*a* of the second front end pushing-up portion 116. Furthermore, the inclined surface 114*a* of the first front end pushing-up portion 114 starts an inclination from this side of the insertion direction of the developing unit 34 and finishes the inclination in the back side of the insertion direction of the developing unit 34 than the inclined surface 116*a* of the second front end pushing-up portion 116. That is, the inclined surface 114*a* of the first front end pushing-up portion 114 has a longer length in the insertion direction of the developing unit 34 and a larger height difference form a lower end to an upper end thereof in comparison with those of the inclined surface 116*a* of the second front end pushing-up portion 116.

Furthermore, there is formed on the bottom wall 104 of the developing unit attaching portion 102 with an engaging hole 118 that receives the stopper 90 provided on the developing unit 34 in an end portion in this side of the insertion direction of the developing unit 34.

Figure 10:
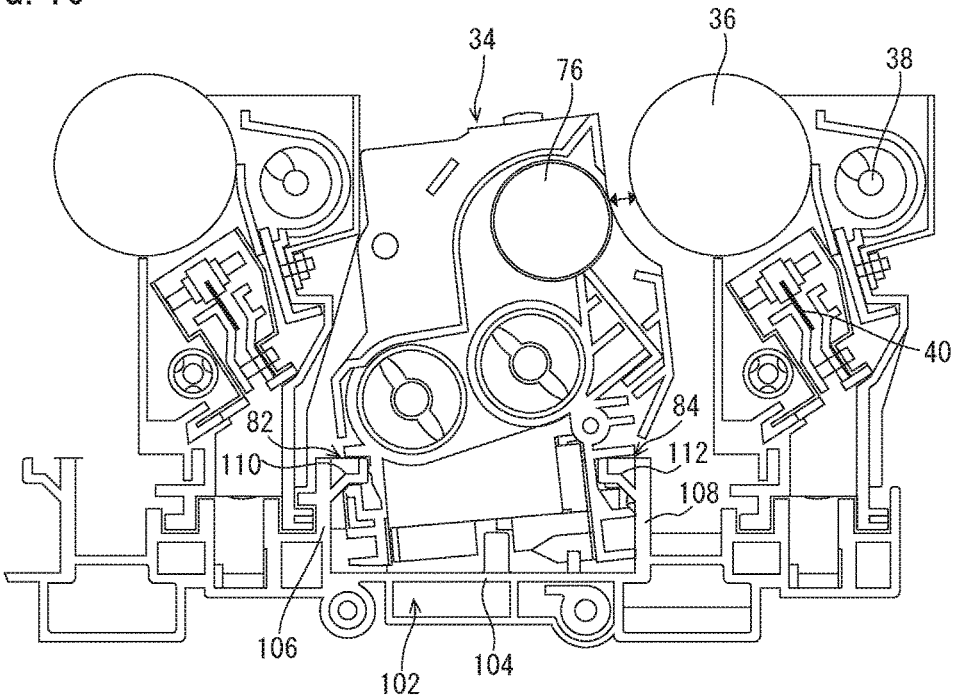
FIG. 10 is an illustration view showing a state under insertion of the developing unit.
Figure 11:
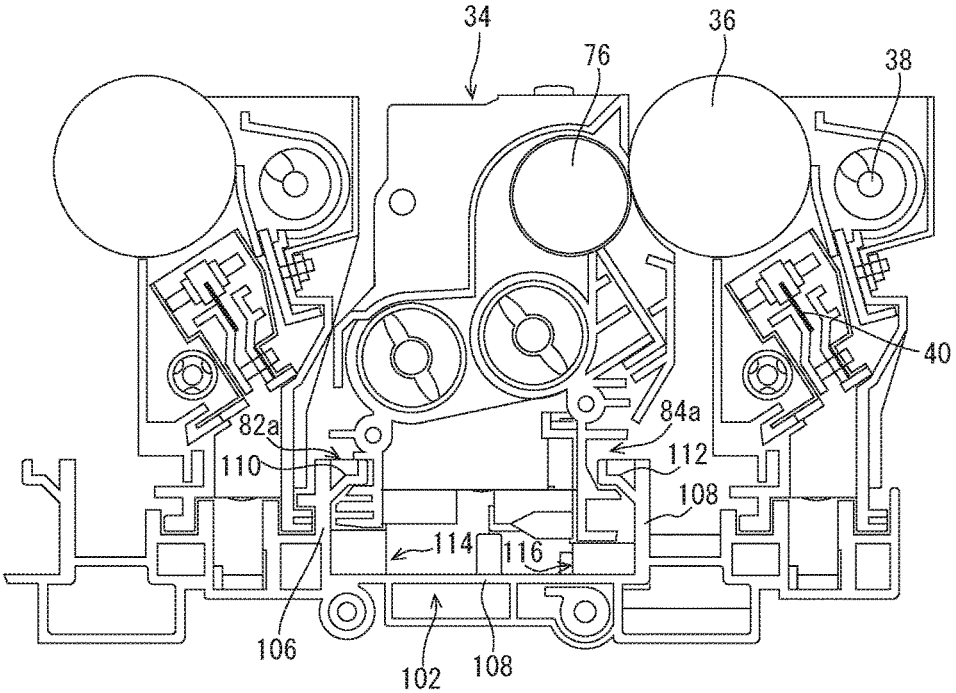
FIG. 11 is an illustration view showing a state at the time of completion of the insertion of the developing unit.

Subsequently, with reference to FIG. 10 and FIG. 11, a motion of the developing unit 34 at the time of attaching the developing unit 34 to the developing unit attaching portion 102 will be described. FIG. 10 is an illustration view showing a state under insertion of the developing unit 34, and FIG. 11 is an illustration view showing a normal attaching state after completion of the insertion of the developing unit 34.

During a period from a start of insertion to the developing unit attaching portion 102 until just before completion of the insertion, as shown in FIG. 10, the developing unit 34 is guided so as to be moved on a position deviated below in a state the same is inclined from a normal posture (position). Then, during a period from just before completion of the insertion until completion of the insertion, the developing unit 34 is lifted and turned according to an insertion operation therefor so as to be brought close to the photoreceptor drum 36, and positioned so as to take a normal state where an outer periphery surface of the developing roller 76 is brought close to an outer periphery surface of the photoreceptor drum 36 as shown in FIG. 11. That is, only by an operation of attaching the developing unit 34 to the developing unit attaching portion 102, the developing unit 34 is positioned so as to take a normal posture. Such an action at the time of insertion of the developing unit 34 is performed by the insertion guide comprising the above-described guide grooves 82 and 84, the guide projections 110 and 112, the rear end pushing-up portions 86 and 88, and the front end pushing-up portions 114 and 116.

Specifically, when attaching the developing unit 34 to the developing unit attaching portion 102, the guide projections 110 and 112 of the developing unit attaching portion 102 are fit to the guide grooves 82 and 84 of the developing unit 34, and the developing unit 34 is pushed in a longitudinal direction thereof to be slid as it is. At this time, since the second guide groove 84 is formed in a height position lower than the first guide groove 82 while the first guide projection 110 and the second guide projection 112 are formed in the same height position, it is possible to stably maintain the developing unit 34 in a state where it is inclined from the normal posture during a period from a start of insertion until just before completion of the insertion.

If pushing the developing unit 34 continuously, the tip portion of the developing unit 34 reaches the front end pushing-up portions 114 and 116 of the developing unit attaching portion 102 just before completion of the insertion. Thereafter, the tip portion of the developing unit 34 runs aground on the horizontally flat surfaces 114*b* and 116*b* via the inclined surfaces 114*a* and 116*a* of the front end pushing-up portions 114 and 116 and the rear end portion of the developing unit 34 runs aground on the bottom wall 104 via the inclined surfaces 86*a* and 88*a* of the rear end pushing-up portions 86 and 88, whereby the entire developing unit 34 can be lifted upward during a period from just before completion of the insertion until completion of the insertion. At this time, since the inclined surfaces 86*a* and 114*a* of the first rear end pushing-up portion 86 and the first front end pushing-up portion 114 have height differences larger than those of the inclined surfaces 88*a* and 116*a* of the second rear end pushing-up portion 88 and the second front end pushing-up portion 116, the developing unit 34 is turned clockwise with using a lower end of the right side wall as a fulcrum. That is, the developing unit 34 is turned while being lifted by the rear end pushing-up portions 86 and 88 and the front end pushing-up portions 114 and 116 during a period from just before completion of insertion until completion of the insertion, whereby the developing unit 34 can be brought close to the photoreceptor drum 36 and positioned so as to take a normal posture (position).

After completion of the insertion of the developing unit 34, the stopper 90 is moved to a lock position by turning the lock lever 92. Accordingly, the stopper 90 is fit into the engaging hole 118, and thus, a motion of the longitudinal direction of the developing unit 34 is prevented, whereby the developing unit 34 can be fixed in the normal attaching state.

In addition, when removing (withdrawing) the developing unit 34 from the developing unit attaching portion 102, the insertion guide comprising the above-described guide grooves 82 and 84, the guide projections 110 and 112, the rear end pushing-up portions 86 and 88, and the front end pushing-up portions 114 and 116 functions as a withdrawal guide, and the developing unit 34 is guided so as to perform a motion contrary to the motion at the time of above-described insertion. That is, the developing unit 34 is moved downward while being turned so as to be separated from the photoreceptor drum 36 during a period from a start of withdrawal until just after the start of the withdrawal. Then, the developing unit 34 is guided so as to be moved on a position deviated below in a state where it is inclined from the normal posture during a period from just after the start of the withdrawal until just before completion of the withdrawal.

As described above, according to this first embodiment, since the developing unit 34 is guided so as to be moved in a state where the developing unit 34 is inclined from the normal posture, in comparison with a case where the developing unit 34 is moved in parallel to an approximately horizontal direction, it is possible to ensure a distance between the developing unit 34 and the photoreceptor drum 36 without using a space in a horizontal direction not so much. Furthermore, since the developing unit 34 is made a state where it is inclined from the normal posture and guided so as to be moved on a position deviated below, it is possible to more adequately ensure the distance between the developing unit 34 and the photoreceptor drum 36.

Furthermore, since the developing unit 34 is positioned so as to take the normal posture with using the insertion guide that is constituted by projections and grooves such as the guide grooves 82 and 84, the guide projections 110 and 112, the rear end pushing-up portions 86 and 88, the front end pushing-up portions 114 and 116, etc., it is no need to separately provide a turning mechanism for the developing unit 34 interlocked with a control lever etc. Furthermore, since the developing unit 34 is positioned in the normal posture only by performing an operation of inserting the developing unit 34, an operation burden by a user can be reduced.

Therefore, according to the first embodiment, it is possible to attain miniaturization of the image forming apparatus 10 and prevent increase of the number of components constituting the image forming apparatus 10. Furthermore, it is possible to reduce an operation burden by a user.

[Second Embodiment]

Next, an image forming apparatus 10 that is the second embodiment according to the present invention will be described. In this second embodiment, structure of the insertion guide provided in the developing unit 34 and the developing unit attaching portion 102 differs from the structure of the above-described first embodiment. Since other portions are the same or similar to the above-described first embodiment, a description duplicate with the first embodiment is omitted or simplified.

Although illustration is omitted, in the second embodiment, positions that the guide grooves 82 and 84 and the guide projections 110 and 112 are formed are contrary to those of the first embodiment. That is, with respect to both outer side surfaces 80*a* and 80*b* of the developer vessel 80, the guide projections 110 and 112 protruded outward are formed with a predetermined interval along the insertion direction of the developing unit 34. On the other hand, with respect to inner surfaces of both side walls 106 and 108 of the developing unit attaching portion 102, the guide grooves 82 and 84 extended in a shape of a straight line along the insertion direction of the developing unit 34 are formed. In such circumstances, the first guide projection 110 that is formed on the left outer side surface 80*a* of the developing unit 34 is formed in a position higher than a height position of the second guide projection 112 that is formed on the outer right side surface 80*b* of the developing unit 34 in a state where the developing unit 34 takes a normal posture, for example. Furthermore, the guide grooves 82 and 84 formed on both side walls 106 and 108 of the developing unit attaching portion 102 are formed in the same height position, respectively.

In also this second embodiment, the same or similar advantages as those of the first embodiment can be expected, and it is possible to attain miniaturization of the image forming apparatus 10 and prevent increase of the number of components constituting the image forming apparatus 10. Furthermore, it is possible to reduce an operation burden by a user.

In addition, although the height positions in right and left are made to be different from each other with respect to the guide grooves 82 and 84 or the guide projections 110 and 112 that are formed on the developing unit 34 in order to make the developing unit 34 an inclined state in the above-described first and second embodiments, the height positions in right and left with respect to the guide projections 110 and 112 or the guide grooves 82 and 84 that are formed on the developing unit attaching portion 102 may be made different from each other.

[Third Embodiment]

Subsequently, an image forming apparatus 10 that is the third embodiment according to the present invention will be described. In this third embodiment, structure of the insertion guide provided in the developing unit 34 and the developing unit attaching portion 102 differs from the structure of the above-described first embodiment. Since other portions are the same or similar to the above-described first embodiment, a description duplicate with the first embodiment is omitted or simplified.

Although illustration is omitted, in the third embodiment, as the rear end pushing-up portion provided on the developing unit 34, only the first rear end pushing-up portion 86 in a side of a lower end of the left side wall of the developer vessel 80 is formed, and the second rear end pushing-up portion 88 in a side of a lower end of the right side wall is not formed. Furthermore, as the front end pushing-up portion provided in the developing unit attaching portion 102, only the first front end pushing-up portion 114 in a side of the left side wall 106 is formed, and the second front end pushing-up portion 116 in a side of the right side wall 108 is not formed.

Then, the developing unit 34 is guided by the insertion guide comprising the guide grooves 82 and 84, the guide projections 110 and 112, the first rear end pushing-up portion 86 and the first front end pushing-up portion 114 so as to be moved on a position departed from the photoreceptor drum 36 in a state the same is inclined from the normal posture (position) during a period from a start of insertion into the developing unit attaching portion 102 until just before completion of the insertion. Then, during a period from just before completion of the insertion until completion of the insertion, the developing unit 34 is turned so as to be brought close to the photoreceptor drum 36 according to an insertion action, and positioned in the normal posture that an outer periphery surface of the developing roller 76 is brought close to an outer periphery surface of the photoreceptor drum 36.

In also this third embodiment, the same or similar advantages as the first embodiment can be expected, and it is possible to attain miniaturization of the image forming apparatus 10 and prevent increase of the number of components constituting the image forming apparatus 10. Furthermore, it is possible to reduce an operation burden by a user.

In addition, specific structure of the insertion guide is not limited to the structure adopted in each above-described embodiment, and thus can be changed suitably. For example, the developing unit 34 may be turned while being lifted according to an insertion action during a period from just before completion of insertion until completion of the insertion of the developing unit 34 with using only the guide grooves and the guide projections that are provided in the both side portions of the developing unit 34 and the developing unit attaching portion 102. Furthermore, the guide groove and the guide projection for maintaining the developing unit 34 in its inclined state, for example may be formed on a bottom surface of the developing unit 34, a bottom wall 104 of the developing unit attaching portion 102 or the like.

Furthermore, although the multifunction peripheral combining a copying function, a facsimile function, a printer function, etc. is exemplified as the image forming apparatus 10 in each above-described embodiment, the image forming apparatuses 10 may be either one of a copying function, a facsimile function, a printer function, etc. or a multifunction peripheral combining these at least two.

Furthermore, although the image forming apparatus 10 using the developer consisting of two components, a toner and a carrier, is explained in each above-described embodiment, the present invention is applicable also to an image forming apparatus using an mono-component developer. Furthermore, internal structure of the developing unit 34 can be suitably changed. For example, the first transporting member 72 and the second transporting member 74 may be arranged so as to be aligned in a vertical direction instead in a horizontal direction, and further a third transporting member may be provided.

Furthermore, structural changes in the above-described second and third embodiments are explained individually; however, a technical feature that is described in each embodiment or each modification may be adopted simultaneously by combining them.

Although the present invention has been mentioned and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising a developing unit having a developing roller that supplies a toner to an electrostatic latent image bearing member, and a developing unit attaching portion that is provided in an apparatus main body, to or from which the developing unit is insertable or extractable, the developing unit being inserted to or extracted from the developing unit attaching portion in a state where the electrostatic latent image bearing member is attached to the apparatus main body, comprising:

an insertion guide that guides the developing unit so as to be moved on a position departed from the electrostatic latent image bearing member when inserting the developing unit into the developing unit attaching portion, and positions the developing unit in an image forming position according to an insertion operation of the developing unit.

2. The image forming apparatus according to the claim 1, wherein the insertion guide guides the developing unit so as to be moved on a position that a whole of the developing unit is deviated below, and lifts the developing unit at a time of positioning, whereby the developing unit is brought close to the electrostatic latent image bearing member.

3. The image forming apparatus according to the claim 1, wherein the insertion guide has at least one guide groove and at least one guide projection that are fit to each other in a slidable manner, and one of the guide groove and the guide projection is provided on the developing unit attaching portion and the other is provided on the developing unit.

4. The image forming apparatus according to the claim 1, wherein the insertion guide comprises a first front end pushing-up portion that is provided on the developing unit attaching portion in an end portion of the back side of the insertion direction of the developing unit and a side portion opposite to the electrostatic latent image bearing member, and a first rear end pushing-up portion that is provided on the developing unit in an end portion of this side of the insertion direction of the developing unit and the side portion opposite to the electrostatic latent image bearing member.

5. The image forming apparatus according to the claim 4, wherein the insertion guide comprises a second front end pushing-up portion that is provided on the developing attaching portion in an end portion of the back side of the insertion direction of the developing unit and a side portion in a side of the electrostatic latent image bearing member, and a second rear end pushing-up portion that is provided on the developing unit in an end portion of this side of the insertion direction of the developing unit and the side portion in a side of the electrostatic latent image bearing member.

6. The image forming apparatus according to the claim 1, wherein the insertion guide includes guide grooves, and the guide grooves are formed on both sides of the developing unit attaching portion or the developing unit.

7. The image forming apparatus according to the claim 1, wherein the insertion guide includes guide projections, and the guide projections are formed on both sides of the developing unit attaching portion or the developing unit.

* * * * *